United States Patent [19]

McCullough et al.

[11] 3,994,636

[45] Nov. 30, 1976

[54] AXIAL COMPLIANCE MEANS WITH RADIAL SEALING FOR SCROLL-TYPE APPARATUS

[75] Inventors: John E. McCullough, Carlisle; Robert W. Shaffer, Arlington, both of Mass.

[73] Assignee: Arthur D. Little, Inc., Cambridge, Mass.

[22] Filed: Mar. 24, 1975

[21] Appl. No.: 561,479

[52] U.S. Cl. ..... 418/55; 418/142

[51] Int. Cl.[2] ..... F01C 1/02; F04C 17/02; F01C 19/08

[58] Field of Search ..... 418/55, 142, 144

[56] References Cited

UNITED STATES PATENTS

| | | | |
|---|---|---|---|
| 801,182 | 10/1905 | Creux | 418/55 |
| 3,655,304 | 4/1972 | Sturmer | 418/179 |
| 3,884,599 | 5/1975 | Young et al. | 418/55 |

FOREIGN PATENTS OR APPLICATIONS

| | | | |
|---|---|---|---|
| 1,395,747 | 3/1965 | France | 418/142 |
| 1,803,533 | 5/1970 | Germany | 418/142 |

*Primary Examiner*—John J. Vrablik
*Attorney, Agent, or Firm*—Bessie A. Lepper

[57] ABSTRACT

Axial compliance/sealing means are provided for scroll-type apparatus. These means comprise seal elements associated with the involute wraps which are urged by an axial force to make sealing contact with the end plates of the opposing scroll members. The axial force may be pneumatically or mechanically applied and the resulting axial contact is of such a nature as to maintain the integrity of the radial sealing within the apparatus. The use of the axial compliance/sealing means allows the contacting surfaces through which radial sealing is effected to be machined to conventional accuracy, and provides automatic compensation for temperature differentials within the apparatus as well for any uneven wear of the scroll members.

21 Claims, 20 Drawing Figures

AXIAL COMPLIANCE MEANS WITH RADIAL SEALING FOR SCROLL-TYPE APPARATUS

This invention relates to scroll-type apparatus and more particularly to scroll-type apparatus having axial compliance/sealing means, with radial sealing capabilities, which materially reduce the problems of constructing the scroll-type apparatus and which enhance its extended operation.

There is known in the art a class of devices generally referred to as "scroll" pumps, compressors and engines wherein two interfitting spiroidal or involute spiral elements of like pitch are mounted on separate end plates. These spiral elements are angularly and radially offset to contact one another along at least one pair of line contacts such as between spiral curved surfaces. A pair of line contacts will lie approximately upon one radius drawn outwardly from the central region of the scrolls. The fluid volume so formed therefore extends all the way around the central region of the scrolls. In certain special cases the pocket or fluid volume will not extend the full 360° but because of special porting arrangements will subtend a smaller angle about the central region of the scrolls. The pockets define fluid volumes, the angular position of which varies with relative orbiting of the spiral centers; and all pockets maintain the same relative angular position. As the contact lines shift along the scroll surfaces, the pockets thus formed experience a change in volume. The resulting zones of lowest and highest pressures are connected to fluid ports.

An early patent ot Creux (U.S. Pat. No. 801,182) describes this general type of device. Among subsequent patents which have disclosed scroll compressors, and pumps are U.S. Pat. Nos. 1,376,291, 2,475,247, 2,494,100, 2,809,779, 2,841,089, 3,560,119, 3,600,114, 3,802,809 and 3,817,664 and British Patent 486,192.

Although the concept of a scroll-type apparatus has been known for some time and has been recognized as having some distinct advantages, the scroll-type apparatus of the prior art has not been commercially successful, primarily because of sealing and wearing problems which have placed severe limitations on the efficiencies, operating life, and pressure ratios attainable. Such sealing and wearing problems are of both radial and tangential types. Thus effective axial contacting must be realized between the ends of the involute spiral elements and the end plate surfaces of the scroll members which they contact to seal against radial leakage and achieve effective radial sealing; and effective radial contacting with minimum wear must be attained along the moving line contacts made between the involute spiral elements to seal against tangential leakage.

One approach to the attainment of acceptable radial sealing in prior art apparatus has been to machine the components (wraps and end plates) to accurate shapes for fitting with very small tolerances to maintain radial sealing gaps sufficiently low to achieve useful pressure ratios. This is difficult to do and resembles the problem of constructing apparatus with a reciprocating piston without the use of sealing rings. In other prior art devices, radial sealing has been achieved through the use of one or more mechanical axial constraints, e.g., bolts to force the surfaces into contact (U.S. Pat. No. 3,011,694) requiring precise adjustment to attain efficient radial sealing without undue wearing. If during extended operation of such devices this adjustment is disarranged by one component experiencing more wear, or by any other mechanism, the problem of wear of other components may grow progressively worse until satisfactory radial sealing is no longer obtained.

Since the use of surfaces machined to close tolerances or the use of mechanical constraints such as bolts to force axial contacts are not suitable techniques for achieving radial sealing in commercially produced scroll apparatus, more recent techniques for achieving effective radial sealing have included the use of a complaint fixed scroll member or the use of a pressurized fluid (with or without springs to provide an augmenting axial force) to urge the scroll members into axial contact.

In the case of the use of a compliant fixed scroll member radial sealing is accomplished by using a fixed scroll member which is capable of undergoing very small excursions in the axial direction and which has some fluid and/or mechanical spring force applying means associated with it. (Such a scroll-type apparatus is described in Ser. No. 408,287, filed in the name of Niels O. Young, now U.S. Pat. No. 3,874,827. )

In the use of pressurized fluid (generally in combination with some form of mechanical spring) to achieve radial sealing, the fluid under pressure is used to axially urge the orbiting scroll member in contact with the fixed scroll member. This fluid may be drawn from one of the moving fluid pockets defined within the apparatus (U.S. Pat. Nos. 3,600,114 and 3,817,664 and application Ser. No. 368,907 filed June 11, 1973, in the names of Niels O. Young and John E. McCullough and assigned to the same assignee as this application and now U.S. Pat. No. 3,884,599) or from an external source (Ser. No. 408,912 filed Oct. 23, 1973, in the name of John E. McCullough and assigned to the same assigner as the present application and now U.S. Pat. No. 3,924,977. )

Finally, in an application filed concurrently herewith in the name of Robert W. Shaffer, Ser. No. 561,478 there is disclosed an improved radial sealing means particularly suited for scroll-type compressors or expanders operating at high pressures. In the scroll-type apparatus using these improved radial sealing means all of the forces required to achieve efficient axial load carrying are pneumatic forces provided by pressurizing all or a selected portion of the apparatus housing. Thus the housing defines with a surface of the orbiting scroll member a pressurizable chamber whereby the fluid pressure within that chamber forces the orbiting scroll into continued axial contact relationship with the fixed scroll member. This pressurizable chamber, which is isolated from the fluid pockets defined within the scroll members, may comprise essentially all of the internal volume of the housing or it may constitute less than the entire housing volume.

The substitution of a compliant fixed scroll member with axial forces applied thereto or of pneumatic forces acting upon the orbiting scroll for the use of bolts to force surface contacts have gone a long way to the solving of the radial sealing problems in sealing problems in scroll-type apparatus. However, these techniques still require very accurate machining of both the contacting surfaces, i.e., the surfaces of the end plates and the surfaces of the involute spiral wrap members. This requirement of accurate machining adds materially to the cost of the scroll type apparatus manufacture. Moreover, any axial misalignment in the apparatus during operating will generally result in uneven wear, thus defeating the attainment of the accurate machining. Finally, radial temperature gradients within the apparatus give rise to uneven dimensional changes in the height of the involute wraps.

It would therefore be desirable to provide a scroll-type apparatus of such a construction that the contacting surfaces need be machined only to conventional accuracy to attain acceptably efficient axial contacting and hence efficient radial sealing. In the scroll-type machinery of this invention this is achieved through the use of what is termed axial sealing/compliance means.

It is therefore a primary object of this invention to provide improved scroll-type apparatus in which the contacting surfaces through which radial sealing is realized need be machined only to conventional accuracy. It is another object of this invention to provide scroll-type apparatus of the character described which incorporate axial compliance/sealing means to effect efficient radial sealing during prolonged operation even though some radial temperature gradients are experienced within the apparatus and uneven wear of the contacting surfaces, through which radial sealing is attained, is brought about. Still another object of this invention is to provide axial compliance/sealing means which do not detract from the attainment of tangential sealing within the scroll-type apparatus. A further object of this invention is to provide axial compliance/-sealing means of the character described which may be used with a lubricant or which may be adapted for apparatus which must operate without lubricants.

It is an additional primary object of the invention to provide scroll-type apparatus including compressors, expansion engines and pumps which may be constructed at costs materially less than heretofore possible.

Other objects of the invention will in part be obvious and will in part be apparent hereinafter.

The invention accordingly comprises the features of construction, combinations of elements, and arrangement of parts which will be exemplified in the constructions hereinafter set forth, and the scope of the invention will be indicated in the claims.

According to this invention, axial compliance/sealing means are provided to maintain continuous radial sealing of the involute wrap member surfaces and the end plate surfaces. These axial compliance/sealing means are preferably used in conjunction with means which provide some axial forces to urge these surfaces in contact. Thus, they are particularly suitable for use with the radial sealing means described in the above identified Ser. Nos. 368,908 408,912, 408,287 and 501,478.

The axial compliance/sealing means of this invention comprise seal elements generally shaped to have the same configuration as the wrap members with which they are used and means to actuate the seal elements by urging them into contact, with a predetermined preload, with the opposing scroll member end plate. The means to actuate the seal element to make axial sealing contact may be pneumatic, mechanical or a combination of pneumatic and mechanical, and they are designed to maintain the required degree of tangential sealing between the moving line contacts of the involute wraps of the orbiting and stationary scroll members.

For a fuller understanding of the nature and objects of the invention, reference should be had to the following detailed description taken in connection with the accompanying drawings in which.

Figure 1:
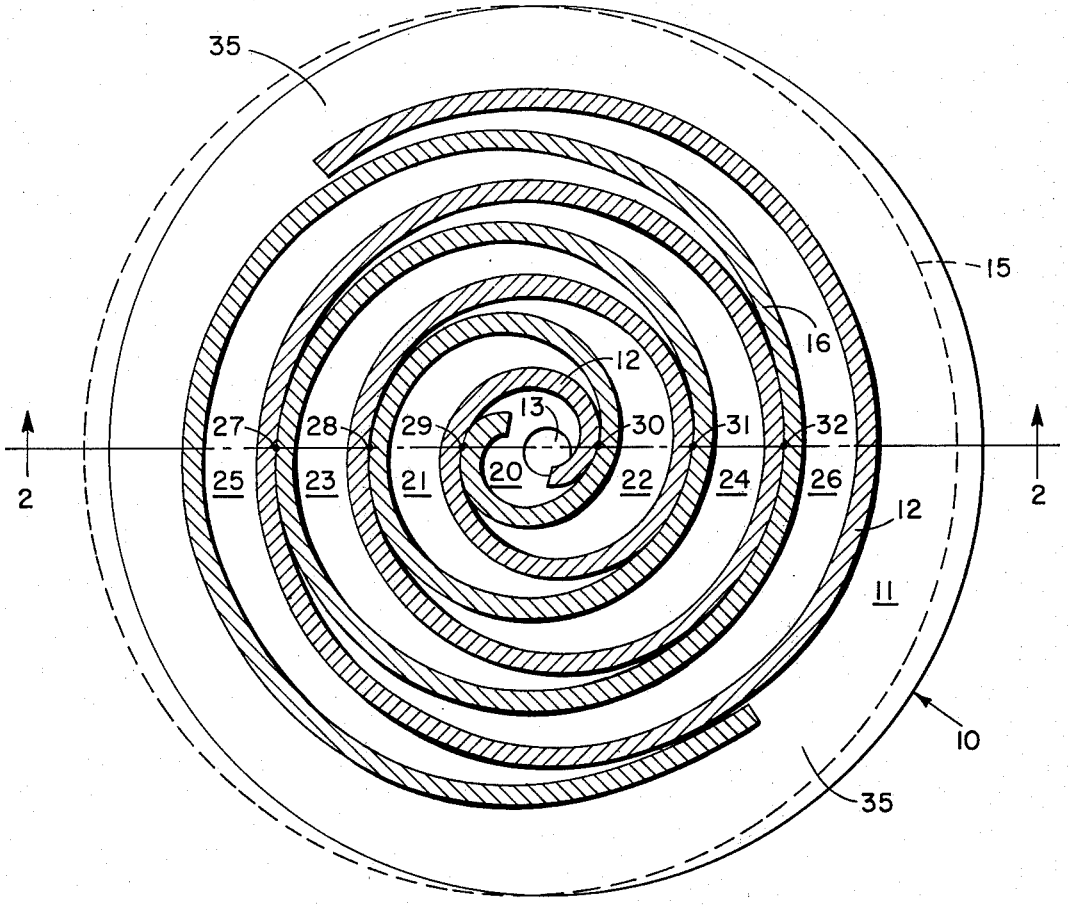
FIG. 1 is a cross section through the involute wrap members of a typical scroll-type apparatus.

Inasmuch as radial sealing within scroll-type apparatus is an essential feature of such apparatus, and further since any axial contacting means must be capable of attaining radial sealing and of maintaining the integrity of the tangential sealing mechanism, it will be helpful, before describing the axial compliance/sealing means of this invention to briefly review the problems of radial and tangential sealing to understand the role which the axial compliance/sealing means of this invention must play in effectively sealing off the pockets within the apparatus.

In the design and construction of scroll-type apparatus tangential sealing can be as important as that of radial sealing. Since tangential and radial sealing are usually, but not always, attained through separate mechanisms, the axial compliance/sealing means of this invention may be employed in scroll-type apparatus using different tangential sealing techniques. However, since the unique tangential sealing means described in the above-identified copending applications Ser. Nos. 368,907 and 408,912 and referred to as radially compliant linking means are believed to represent an important advance in scroll-type apparatus, the axial compliance/sealing means of this invention will be illustrated in a scroll compressor including the tangential sealing means disclosed in Ser. No. 408,912. In this copending application there is disclosed scroll apparatus which provides means to control the radial contacting forces such that tangential sealing is continuously and effectively attained even with wear or when noncompressibles are temporarily present. This means to control radial contacting comprises means to counterbalance at least a fraction of the centrifugal force acting upon the orbiting scroll member and radially compliant mechanical linking means between the orbiting scroll and its drive means.

In one embodiment, the radially compliant mechanical linking means is capable of providing a centripetal force to counterbalance a fraction of the centrifugal force thereby leaving a portion of the centrifugal force available for achieving controlled tangential sealing. In this embodiment the compliant mechanical linking means incorporates mechanical springs to counteract a portion of the centrifugal force. In another embodiment of the drive mechanism of the apparatus described in Ser. No. 408,912, means separate from the radially compliant mechanical linking means, e.g., counterweights, are provided to counterbalance all or nearly all of the centrifugal forces acting upon the orbiting scroll member and the radially compliant linking means, i.e., mechanical springs, are incorporated to provide the desired radial contacting forces. The scroll members are angularly positioned by a coupling of the sliding friction type or rolling element type; the radially compliant linking means may be a slide link or swing link; either one or both of the scroll members may be cooled and the contacting surfaces may be lubricated if desired. This latter type of radial sealing embodying a swing link will be used as illustrative of tangential sealing means in the apparatus described herein.

The principles of the operation of scroll apparatus have been presented in previously issued patents as well as in copending application Ser. No. 368,907, now U.S. Pat. No. 3,884,599. It is therefore unnecessary to repeat a detailed description of the operation of such apparatus. It is only necessary to point out that a scroll-type apparatus operates by moving a sealed pocket of fluid taken from one region into another region which may be at a different pressure. If the fluid is compressed while being moved from a lower to higher pressure region, the apparatus serves as a compressor; if the fluid is expanded while being moved from a higher to lower pressure region it serves as an expander; and if the fluid volume remains essentially constant independent of pressure then the apparatus serves as a pump.

The sealed pocket of fluid is bounded by two parallel planes defined by end plates, and by two cylindrical surfaces defined by the involute of a circle or other suitably curved configuration. The scroll members have parallel axes since in only this way can the continuous sealing contact between the plane surface of the scroll members be maintained. A sealed pocket moves between these parallel planes as the two lines of contact between the cylindrical surfaces move. The lines of contact move because one cylindrical element, e.g., a scroll member, moves over the other. This is accomplished, for example, by maintaining one scroll fixed and orbiting the other scroll. The axial compliance/sealing means of this invention will, for the sake of convenience, be assumed to be used in a positive fluid displacement compressor in which one scroll member is fixed while the other scroll member orbits in a circular path. However, it will be obvious that the invention is equally applicable to expansion engines and pumps.

Throughout the following description the term "scroll member" will be used to designate the component which is comprised of both the end plate and the elements which define the contacting surfaces making movable line contacts. The term "wrap" will be used to designate the elements making moving line contacts. These wraps have a configuration, e.g., an involute of a circle (involute spiral), arc of a circle, etc., and they have both height and thickness.

Figure 2:
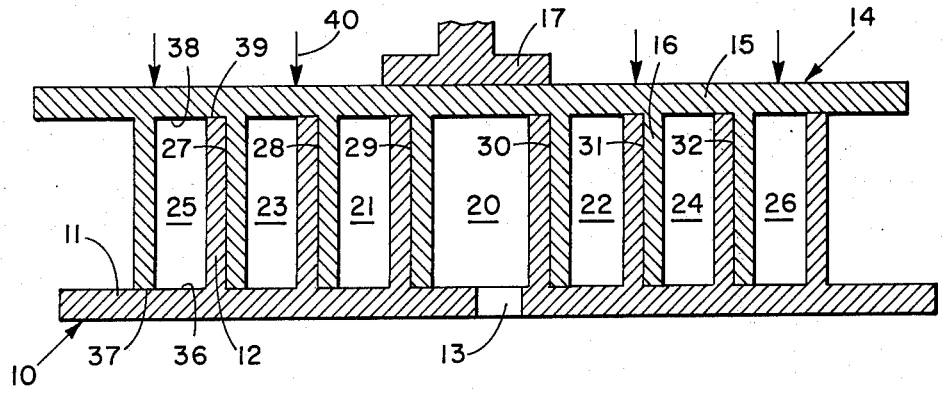
FIG. 2 is a cross section of the typical scroll-type apparatus of FIG. 1 through plane 2—2 of FIG. 1.
Figure 19:
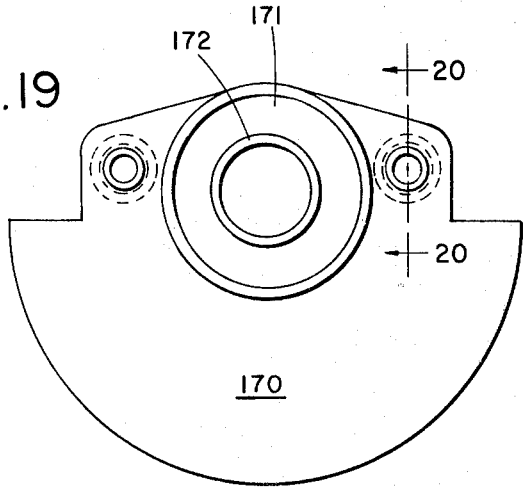
FIG. 19 is a cross section through plane 19—19 of FIG. 18 showing the swing link mechanism incorporated in the orbiting scroll drive means.
Figure 18:
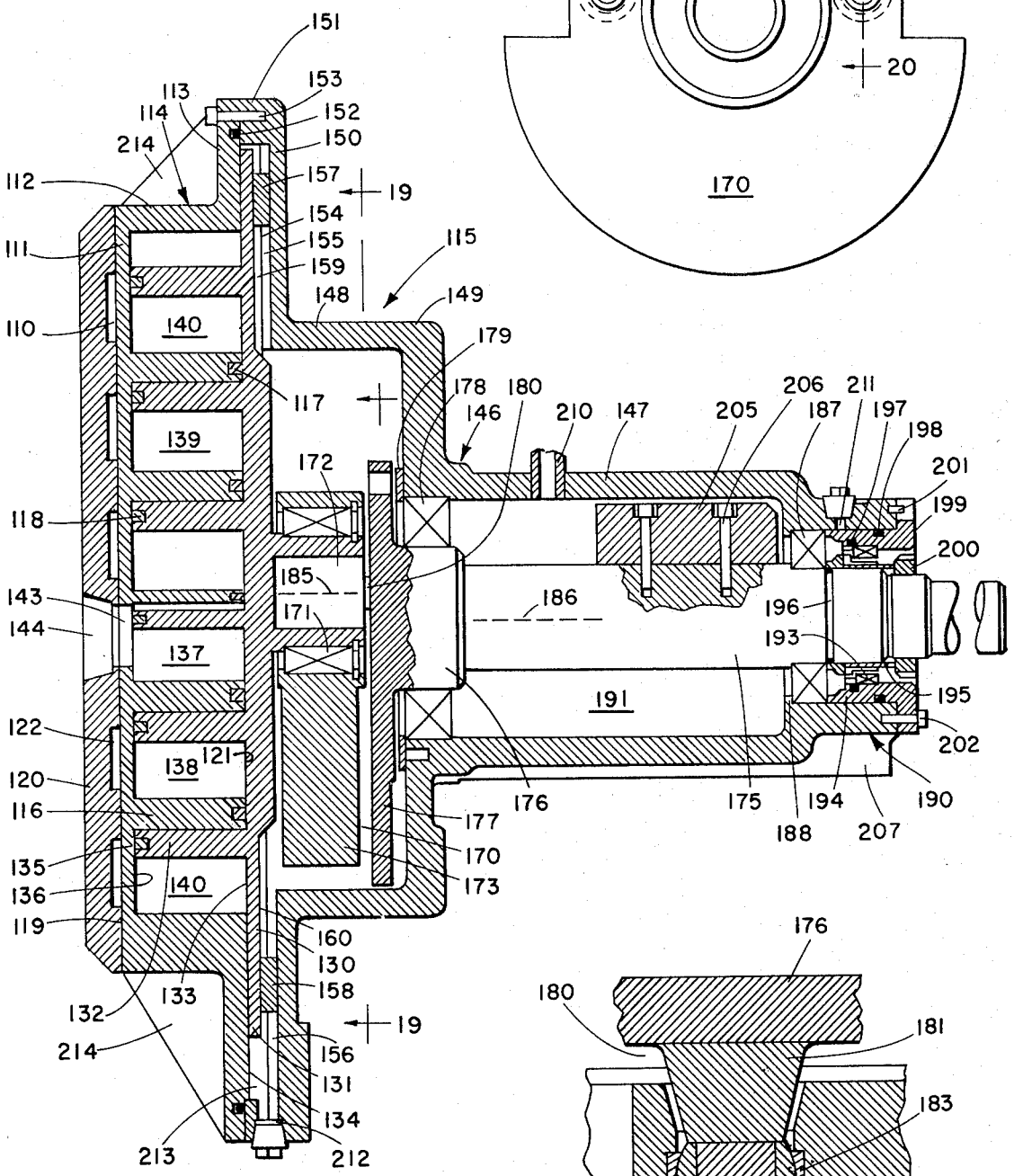
FIG. 18 is a longitudinal cross section of a scroll-type apparatus incorporating the compliance/sealing means of this invention.
Figure 20:
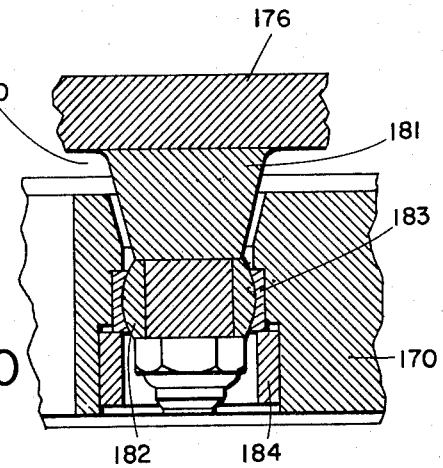
FIG. 20 is a cross section through plane 20—20 of FIG. 19 detailing the connection between the main drive shaft and the swing link mechanism.

FIGS. 1 and 2 are presented to illustrate the problem of providing radial sealing with compliance, while maintaining adequate tangential sealing, without the need for the extremely accurate machining of contacting surfaces. The cross sectional views of FIGS. 1 and 2 show only end plates, wrap members and fluid pockets. A complete scroll-type apparatus embodying the sealing/compliance means of this invention is shown in FIGS. 18–20 and is described in detail below.

In FIGS. 1 and 2, the stationary scroll member 10 is seen to comprise an end plate 11 and a wrap 12. End plate 11 has a centrally located fluid port 13. For convenience in discussing the compliane/sealing means of this invention and the scroll-type apparatus in which these means are incorporated, the apparatus will hereinafter be assumed to be a compressor. However, it will be apparent to those skilled in the art that the compliance/sealing means are equally applicable to scroll-type apparatus used as expansion engines or as pumps.

In FIGS. 1 and 2 the orbiting scroll member 14 is likewise formed of an end plate 15 and an involute wrap 16. In the simplified drawing of FIG. 2, the orbiting scroll member is shown to be attached to a drive shaft 17. In operation, the orbiting scroll member 14 is driven to describe an orbit while the two scroll members are maintained in a fixed angular relationship through the use of a suitable coupling means, not shown. In its orbiting motion, the orbiting scroll member defines one or more moving fluid pockets, i.e., pockets 20-26. These pockets are bounded radially by sliding or moving line contacts, i.e., contacts 27–32, lying generally on a line running through the center of the apparatus. As fluid is taken in from the peripheral zone 35 surrounding the wraps, it is introduced in the pockets and compressed as the pockets become smaller in volume as they approach the central pocket 20. Thus, provided efficient tangential sealing is effected along the moving contact lines defining the fluid pockets, and efficient radial sealing is achieved between the surface 36 of end plate 11 of stationary scroll member 10 and the end surface 37 of orbiting wrap 16 and between surface 38 of end plate 15 of orbiting scroll member 14 and the end surface 39 of stationary wrap 12, the pockets from outside inwardly will define zones of increasing fluid pressure and there will exist a pressure differential, $\Delta P$ across each line contact. It is therefore apparent that achieving radial contact between the wrap sides as they make sliding contact when the orbiting scroll member is orbited, seals against tangential leakage and hence attains tangential sealing. Likewise, the achieving of axial contact between the wrap ends and the end plate of the opposing scroll member seals against radial leakage and attains radial sealing. It will be appreciated that if the apparatus is an expansion engine, the zones of increasing fluid pressure will be in the same direction, i.e., from the center outwardly since compressed fluid is taken in through fluid port 13 and expanded fluid discharged at the periphery.

As noted above, preferred apparatus for attaining the required tangential sealing while minimizing wear and linkage problems are described in copending U.S. Ser. Nos. 368,907 and 408,912; while one preferred embodiment for effecting axial loading is described in detail in copending Ser. No. 561,478 filed concurrently with this application. The compliance/sealing means of this invention is designed to be used in conjunction with suitable means for developing axial and radial contacting forces of the type described in Ser. No. 804,912 or with any other suitable types of such means. It will be immediately apparent from the drawing of FIG. 2 that no matter what axial forces (illustrated by arrows 40) are brought to bear on the orbiting scroll member 14, highly efficient radial sealing can not be attained unless wrap surfaces 37 and 39 and end plate surfaces 36 and 38 are very accurately machined. Moreover, the wraps must be formed to have the same heights throughout their entire lengths. Such machining can, of course, be attained at considerable expense; and it is also, of course, possible to construct each wrap to dimensions within the necessary tolerances, again at considerable expense. However, during operation, the advantages of the achievement of such accuracies can be materially depleted.

One factor involved in such a depletion is the radial temperature profile which will exist through the apparatus. In a compressor, the temperature of the fluid in the fluid pockets will increase radially inward and even through cooling means are provided (such as illustrated in FIG. 18) the wraps 12 and 16 will be subjected to a temperature differential causing the heights of the wraps to vary in accordance with the thermal expansion coefficient of the material from which they are formed. Another factor influencing the depletion of the advantages of the achievement of very accurate machining is the possibility of uneven wear within the apparatus during operation. It will be evident that if any unbalancing of the apparatus components occurs, it may cause uneven surface wear and lead, in turn, to unwanted leakage, even through these surfaces were accurately machined during manufacture.

Through the use of the compliance/sealing means of this invention it is possible to employ conventional machining, to compensate for temperature profiles and to allow for wear during operation. This compliance/-sealing means comprises a seal element configured to conform to the shape of the wrap and means to actuate the seal element by urging it into contact, with a preselected preload, with the opposing scroll member end plate. These means to urge the seal element into contact with the opposing end plate are positioned within a fluid volume defined within either the wrap end or within the seal element, depending upon the embodiment of seal element used.

The compliance/sealing means are, of course, associated with the involute wraps of both orbiting and stationary scroll members. In FIGS. 3–7 only the stationary wrap is illustrated. However, in FIG. 8 both wraps are shown.

In the embodiment of the seal element of FIGS. 3–8, 10 and 11, this component takes the form of an element, generally but not necessarily of a rectangular cross section, which has an involute configuration corresponding to the configuration of the involute wrap member, e.g., stationary wrap 12 in the drawings, with which it is used. This involute seal element may be formed of a metallic or nonmetallic material. Exemplary of metallic materials are cast iron, steel, bronze and the like and of nonmetallic materials are carbon or plastics such as polytetrafluoroethylene (filled or unfilled), polyimides, and the like. Such material may be of a character as to require lubrication or it may be capable of running dry, in which latter case it is preferably a self-lubricating material such as a filled polytetrafluoroethylene.

Figure 3:
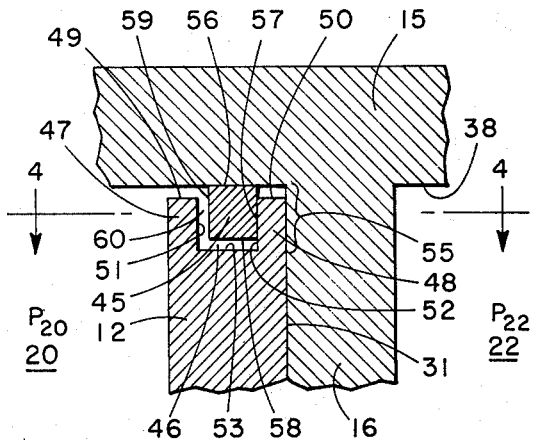
FIG. 3 is an enlarged fragmentary detailed cross section of contacting involutes showing one embodiment of the seal element of the compliance/sealing means of this invention and pneumatic means for actuating the seal element and for maintaining radial sealing.
Figure 4:
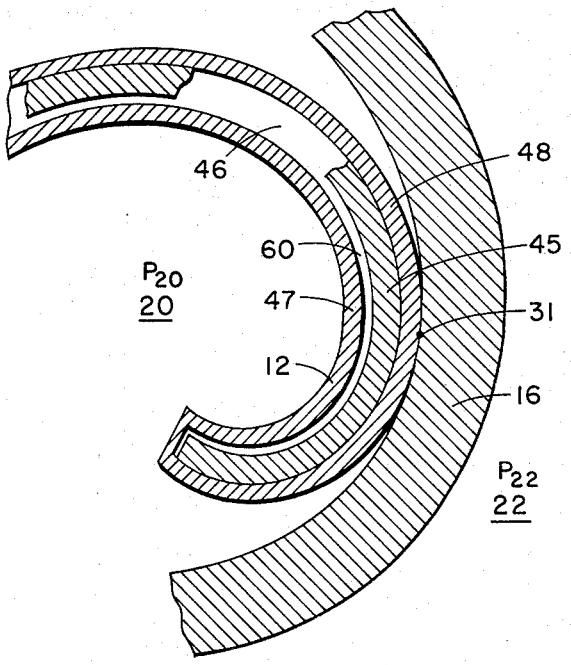
FIG. 4 is a cross sectional view of a portion of one involute wrap member taken through plane 4—4 of FIG. 3, showing the seal element of the embodiment of FIG. 3.

In FIGS. 3 and 4 the seal element 45 is shown to be rectangular in cross section and the contacting surface 39 (FIGS. 1 and 2) of stationary wrap 12 is grooved to define a channel 46, the width of which is slightly greater than the width of seal element 45. The groove defining involutely-configured channel 46 is, as will be seen in FIGS. 3 and 4, formed of two parallel involute extensions 47 and 48, having end surfaces 49 and 50 and side walls 51 and 52, respectively. Surface 53 completes the walls of the grooves.

Together seal element 45 and channel 46 define the boundaries of the compliance/sealing means 55. Seal element 45 can be seen to have four sides 56, 57, 58 and 59. This basic structure of seal element and groove configuration is maintained throughout the seal embodiment illustrated in FIGS. 3–8, 10 and 11.

FIG. 3 represents one of the simplest structures of the compliance/sealing means of this invention. In this embodiment, pneumatic forces alone are used to urge sealing surface 56 of seal element 45 in contact with surface 38 of end plate 15 of the orbiting scroll member and seal element surface 57 in contact with groove wall 52 to maintain radial sealing. Assuming that the apparatus (illustrated in fragmentary detail in FIG. 3) is a compressor having the basic scroll member structure illustrated in FIGS. 1 and 2, it will be immediately apparent that the fluid pressure $P_{20}$ obtaining in central fluid pocket 20 is greater that the fluid pressure $P_{22}$ in adjacent fluid pocket 22. During scroll operation, a pressure differential $\Delta P = P_{20} - P_{22}$ therefore exists across the involute wraps 12 and 16 at the point 31 where they make sliding line contact, i.e., where tangential sealing is effected. Thus there may be said to exist zones of different fluid pressure on the two sides of the moving line contacts. As the compressor is started up and before ΔP has assumed any significant value, the sealing element is free to float within channel 46. However, as ΔP increases, the pressure of the fluid leaking into channel 46 through the passage 60, defined between wall 51 and seal element surface 59, forces seal element axially toward end plate 15 to make contact through surface 56 with end plate surface 38 as well as radially outward to make contact through surface 57 with side wall 52 of the groove. Thus through the use of seal element 45 which has freedom of movement within channel 46 radial sealing is attained while the integrity of the tangential seal, of whatever nature, is maintained even through there may be a temperature gradient in the machine and some uneven wear may be experienced during operation.

Although the embodiment of FIG. 3 is the most simple configuration of the axial compliance/sealing means of this invention, it does require very accurate geometry for the contacting surfaces of the seal element and groove walls, i.e., surfaces 57 and 52. The contact pressures in both the axial and radial directions are dependent upon the fluid pressure that acts up the two surfaces of the seal element and this fluid pressure is, as noted above, a function of ΔP. The choice of material from which to construct the seal element in the compliance/sealing means of FIG. 3 is dependent upon such factors as the kind of operating environment, the operational life desired, operating temperature, type of lubrication used and convenience and cost of manufacturing techniques used.

Figure 5:
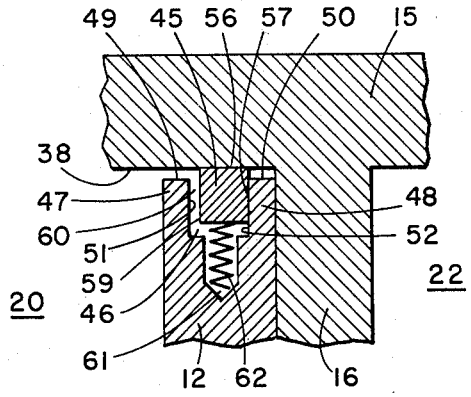
FIG. 5 is a cross sectional detail of the seal element embodiment of FIG. 3 using mechanical spring means for axially actuating the seal element and pneumatic forces to maintain radial sealing.
Figure 6:
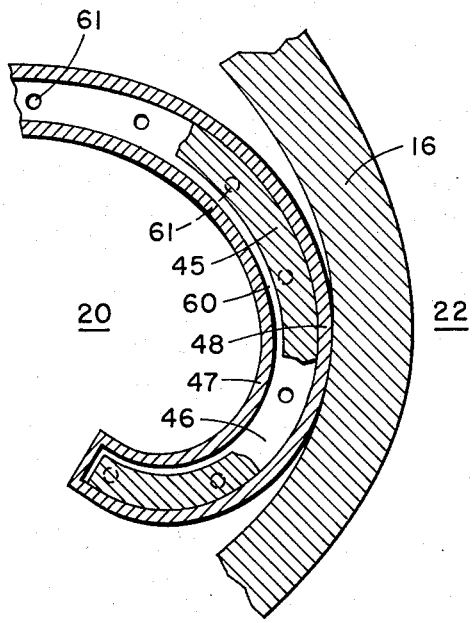
FIG. 6 is a top plane view of an involute wrap member incorporating the compliance/sealing means of FIG. 5 and illustrating the placement of the springs.

In the compliance/sealing means of FIGS. 5 and 6, in which like reference numerals are used to identify like elements, a plurality of spaced springs in compression are used as the primary means to urge the seal element into engagement with the end plate of the opposing scroll; and pneumatic means are used, as in the apparatus of FIG. 3, to maintain radial sealing as well as to augment the axial force of the springs. To this end a number of periodically spaced spring wells 61 are drilled into groove surface 53 and a spring 62 placed in each of them. The number and spacing of springs 62 must be such as to apply an essentially uniform spring force per circumferential unit length of the seal element.

Since springs 62 continuously apply a positive force on the seal element 45 to cause it to contact the surface of the opposing end member, essentially all of the required axial force is present even during start-up and shut-down, a fact which results in more reliable operation during these periods than can be attained through the use of the apparatus of FIG. 3. However, as in the case of the apparatus of FIG. 3, the contacting surface 57 of the seal element and the surface 52 of the channel must be capable of making a precise fit. The choice of material for the seal elements of FIGS. 5 and 6 depends upon essentially the same factors as those listed above for the FIG. 3 embodiment.

Figure 7:
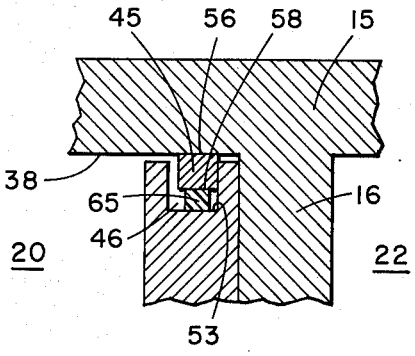
FIG. 7 is a cross sectional detail of the seal element embodiment of FIG. 3 using an elastomeric ring for mechanically actuating the seal element and for maintaining radial sealing.

The embodiment of FIG. 7, like that of FIG. 5, uses mechanical means, i.e., an elastomeric member 65, to urge the seal element 45 into contact with the end plate surface of the opposing scroll member. This elastomeric member 65 may conveniently be formed of a hard rubber (natural or synthetic) or of other similar material. Although the pressure differential existing across the wrap members may be used, as in the apparatus of FIGS. 3 and 5, to provide fluid pressure to force seal element 45 radially outward to maintain radial sealing, this is not necessary. The elastomeric member 65 serves essentially the same purpose as springs 62. However, because there also exists a positive force in both axial directions, the elastomeric member is continuously caused to contact surface 58 of the seal element and surface 53 of the channel-defining groove, thus providing an additional radial sealing means by preventing gas leakage under the seal element 45. The compliance/sealing means of FIG. 7 preferably finds use in apparatus wherein maintenance can be performed regularly, for the materials from which th elastomeric member are made may tend to deteriorate and so these seals may require replacement. Such elastomer members 65 can not, of course, be used in machinery in which the fluid being handled is corrosive to or reactive with the elastomeric material.

Figure 8:
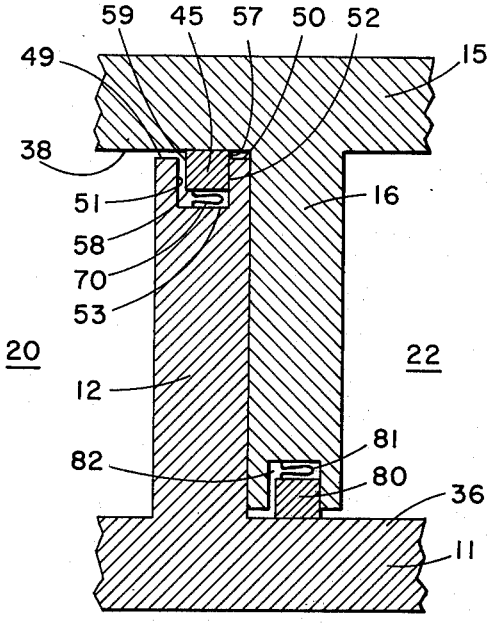
FIG. 8 is a cross sectional detail of the seal element embodiment of FIG. 3 using one embodiment of a mechanical spring/seal to actuate the seal element and attain radial sealing.
Figure 9:
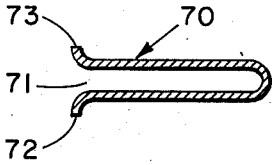
FIG. 9 is an enlarged cross section of the mechanical spring/seal of FIG. 8.
Figure 10:
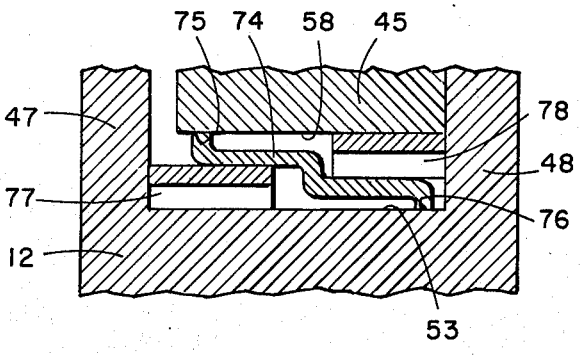
FIG. 10 is an enlarged cross section of another embodiment of a spring/seal to actuate the seal element.
Figure 11:
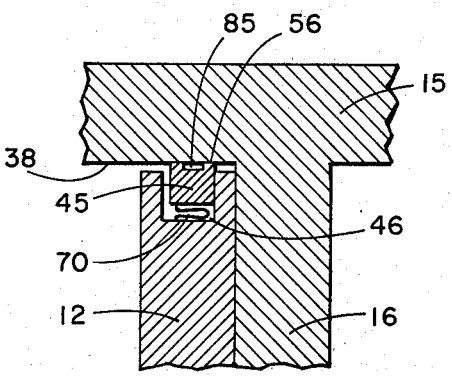
FIG. 11 is a modification of the compliance/sealing means of FIG. 8 showing the incorporation of a lubricant channel in the seal element.

FIGS. 8–11 illustrate the use of a spring/seal as a mechanical means for forcing the seal element 45 to make contact with the end plate to achieve radial sealing while simultaneously providing a gas-tight seal under seal element 45 to maintain the integrity of the radial sealing within the apparatus. In FIGS. 8, 9 and 11 this spring/seal is a U-shaped spring 70. U-shaped spring 70, configured to conform with the involute shape of the wrap, is formed so that when it is installed as shown in FIG. 8 it is in compression. It is placed so that its open end 71 is facing toward the pocket 20 containing the fluid at the higher pressure. In its compressed state in channel 46, end 72 (FIG. 9) makes a sealing contact with surface 53 of channel 46; and end 73 makes sealing contact with surface 58 of seal element 45. Thus no gas can leak from pocket 20 into pocket 22 through channel 46.

Another embodiment of a spring/seal is illustrated in FIG. 10. This spring/seal comprises an involutely configured stepped seal strip 74, the surfaces of the two ends 75 and 76 of which make sealing contact with surfaces 58 and 53, and two opposing involutely configured wave springs 77 and 78 which urge ends 75 and 76 against these surfaces. Thus the spring/seal may be formed as a single member as in U-shaped spring 70, or as a plurality of interacting members as in FIG. 10.

Because spring-seals of the type illustrated in FIGS. 9 and 10 eliminate gas leakage, all of the surfaces involved in the compliance/sealing means of these embodiments using spring/seals may be machined to conventional tolerances while at the same time making it possible to obtain superior results. These superior results come about by reason of the fact that radial sealing is attained through a shifting contact between the seal element and the opposing scroll end plate which is determined by the compression force of the spring/seal and relatively independent of ΔP. The embodiments of FIGS. 8–11 therefore respresent balanced pressure seal elements and preferred means for actuating the seal element.

FIG. 8 illustrates the application of the compliance/-sealing means of this invention to the involute wraps of both the orbiting and stationary scroll members. It will be seen that identical arrangements are used. Thus the seal element 80 makes sealing contact with surface 36 of the end plate 11 of the stationary scroll member under the force of U-shaped spring 81 in channel 82 defined by a groove in the end of wrap 16 which is part of the orbiting scroll member. In the same manner, the compliance/sealing means of FIGS. 3–7 are used with the involute wraps of both the orbiting and stationary scroll members.

In FIG. 11 the seal element 45 is shown to have a lubrication channel 85 to distribute a suitable lubricant between the contacting surfaces 38 and 56. Such lubrication channels may also, of course, be used with the compliance/sealing means of FIGS. 3–8.

Figure 12:
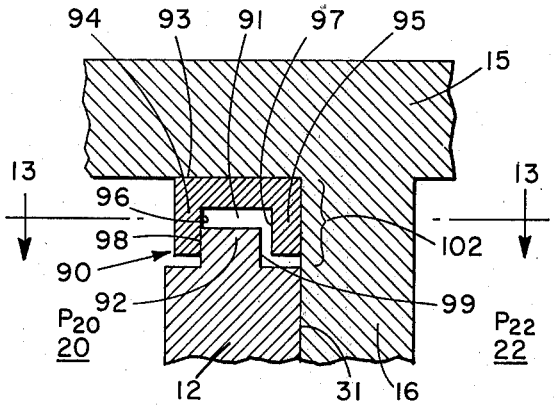
FIG. 12 is an enlarged fragmentary detailed cross section of contacting involutes showing another embodiment of the seal element of the compliance/sealing means of this invention and pneumatic means for actuating the seal element and for maintaining radial sealing.

FIGS. 12–17, in which like elements are given the same reference numbers as in FIGS. 1–11, illustrate another embodiment of the seal element. As will be seen in FIGS. 12 and 13, seal element 90 is configured as a trough to define a chamber 91, and the end of wrap 12 has a central extension member 92 extensible into chamber 91. Seal element 90 has an axial sealing surface 93 for making contact with surface 38 of the orbiting scroll member end plate 15; and side pieces 94 and 95 of seal element 90 have internal surfaces 96 and 97, respectively. Central extension member 92 of the wrap has surfaces 98 and 99 for contacting surfaces 96 and 97 to maintain radial sealing. In operation as shown in FIG. 12, surfaces 96 and 98 make contact. The width of the chamber 91 within the seal element must be slightly greater than the width of the wrap extension 92 to permit some leeway for movement. It is also necessary that the overall width of spring seal element 90 be less than the width of the wrap with which it is associated. This is required so that the sides of the element, e.g., side 95, may if desired leave a small clearance between the sealing element and the adjacent wrap side and does not prevent wrap 12 from making sliding or moving contact with wrap 16 to attain tangential sealing.

Figure 13:
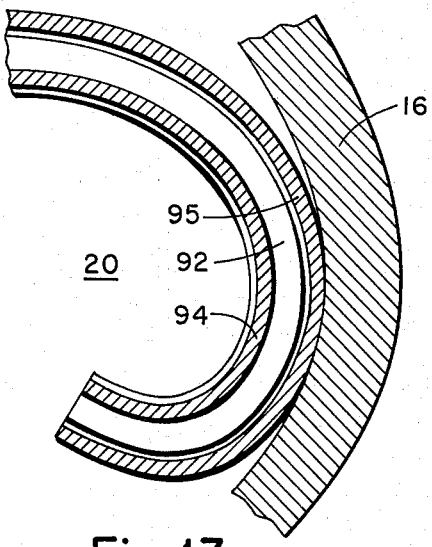
FIG. 13 is a cross sectional view of a portion of one involute wrap member, taken through plane 13—13 of FIG. 12, showing the seal element of the embodiment of FIG. 12.

It will be seen that the compliance/sealing means 102 of FIGS. 12 and 13 functions in the same manner as that described for compliance/sealing means 55 of FIGS. 3 and 4. Fluid pressure derived from pocket 20 serves as pneumatic means to urge seal element 90 into contact with end plate surface 38 as well as to force contact between surfaces 96 and 98 to maintain radial sealing. As in the case of the embodiments of FIGS. 3 and 4, the embodiments of FIGS. 12 and 13 are simple in configuration, but they require surfaces 96/98 to be accurately machined and the apparatus must attain at least a part of full operational speed before the compliance/sealing means is completely effective.

Figure 14:
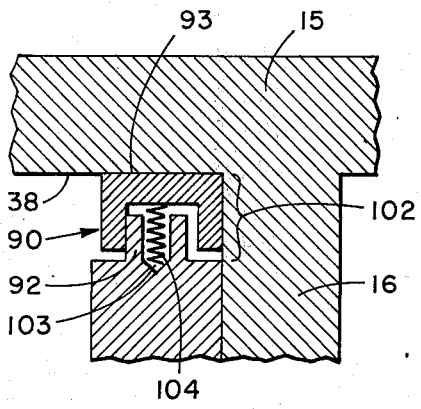
FIG. 14 is a cross sectional detail of the seal element embodiment of FIG. 12 using mechanical spring means for actuating the seal element and pneumatic forces to maintain radial sealing.
Figure 15:
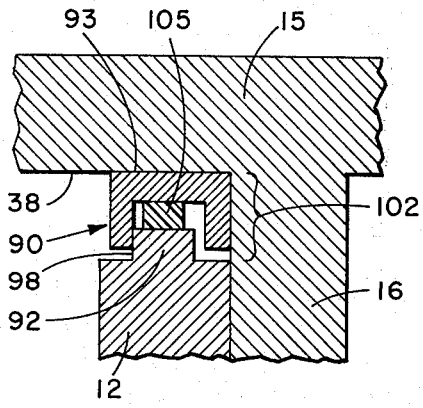
FIG. 15 is a cross sectional detail of the seal element embodiment of FIG. 12 using an elastomeric member for mechanically actuating the seal element and for maintaining radial sealing.
Figure 16:
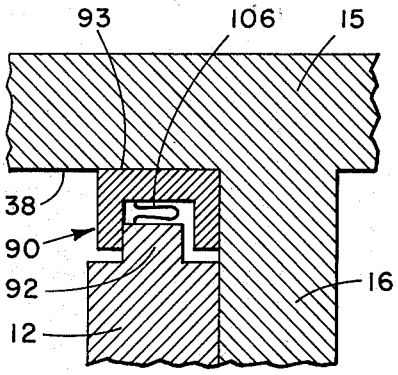
FIG. 16 is a cross sectional detail of the seal element embodiment of FIG. 12 using a mechanical spring/seal to actuate the seal element and attain radial sealing.
Figure 17:
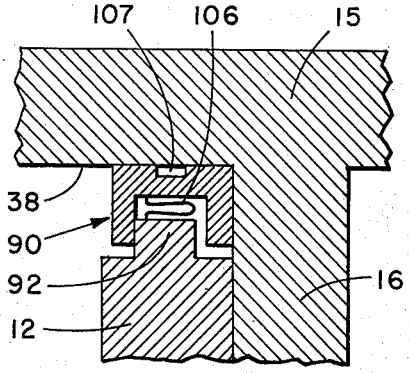
FIG. 17 is a modification of the compliance/sealing means of FIG. 16 showing the incorporation of a lubricant channel in the seal element.

In the embodiment of FIG. 14, the wrap extension 92 has a plurality of spring wells 103 drilled in it and they contain springs 104 in compression to urge seal element 90 in the axial direction to contact surface 38. Essentially the same design considerations and performance characteristics pertain to the embodiment of FIG. 14 as were described above for the embodiment of FIG. 5. Likewise, the embodiments of FIGS. 15–17 are directly comparable in operation to those of FIGS. 7, 8 and 11. FIG. 15 illustrates the use of an elastomeric member 105 with the compliance/sealing means of FIGS. 12 and 13; and FIG. 16 illustrates the use of a spring/seal, e.g., a U-shaped spring 106, identical to that of FIG. 9, in compliance/sealing means 102. Finally, FIG. 17 shows a lubricant channel 107 in the seal element 90. The compliance/sealing means of FIGS. 12–15 may also, of course, have comparable lubricant channels and all of the embodiments of FIGS. 12–17 are used for the wraps of both the orbiting and stationary scroll members as shown in FIG. 8.

FIG. 18 is a longitudinal cross section of an exemplary scroll compressor incorporating the radial compliance/sealing means of this invention. Radial sealing is attained in this exemplary apparatus through the means described in the application filed concurrently herewith in the name of Robert W. Shaffer and assigned to the same assignee as this application. Tangential sealing is attained in this exemplary scroll compressor by the apparatus described in copending application Ser. No. 408,912 filed in the name of John McCullough and assigned to the same assignee.

In the compressor of FIG. 18, the stationary scroll member 110 is formed of an end plate 111 which has a peripheral cylindrical wall 112 terminating in a flange 113, end plate 111, wall 112 and flange 13 forming one section 114 of housing 115. Stationary scroll member 110 has an involute wrap 116 which has the compliance/sealing means of this invention associated with it. These compliance/sealing means are shown for simplicity as only a seal element 118. The complete compliance/sealing means may be any of the embodiments illustrated in FIGS. 3–17. Affixed to the external surface 119 of end plate 111 is a housing plate member 120 which has a spirally shaped groove cut into it. When assembled, this groove and external surface 119 of end plate 111 form a channel 122 through which a fluid coolant is circulated. Channel 122 traces the involute spiral shape of the wrap of the stationary scroll member.

The orbiting scroll member 130 has an end plate 131 and an involute wrap 132 affixed thereto. Involute wrap 132 of the orbiting scroll member also has the compliance/sealing means of this invention associated with it. These means, like compliance/sealing means 117, are shown only as a seal element 118 and they may be any of the embodiments shown in FIGS. 3–17. The surface 133 of end plate 131, with which wrap 132 is integral, makes a sliding seal with surface 134 of flange 113. Likewise, this surface 133 forms a radial seal through compliance/sealing means 117 with surface 121 of the involute wrap 116 of the stationary scroll. In like manner, the surface 135 of involute wrap 132 forms through compliance/sealing means 118 a radial seal with surface 136 of the end plate 111 of the stationary scroll member 110. Thus there are defined one or more fluid pockets, e.g. 137, 138, 139 and 140 within the volume defined between end plates 111 and 131. In the compressor illustrated, the fluid to be compressed is introduced into the peripheral fluid pocket 140 through oppositely disposed inlet ports, not shown, and the compressed fluid is withdrawn from central fluid pocket 137 through discharge port 143 which is adapted to be connected with some compressed fluid utilization means, for example a reservoir (not shown) or other suitable mechanisms, e.g., an expansion engine, through port 144 in housing plate 120. This port 144 is adapted for engagement with a suitable fluid-carrying line (not shown).

The remaining or second section 146 of housing 115 comprises a drive shaft housing 147 and a swing link housing 148 connected through a shoulder 149. Swing link housing 148 terminates in a flange 150 having a peripheral ring 151 through which flange 113 of housing section 114 is joined and sealed through a sealing o-ring 152 by suitable means such as a plurality of bolts 153. The internal surface 154 of flange 150 has two oppositely disposed radial grooves 155 and 156 cut into it to serve as keyways for oppositely disposed keys 157 and 158 on one side of coupling ring 159. The outer surface 160 of the end plate 130 of the orbiting scroll has similar oppositively disposed raidal grooves, not shown, which are spaced 90 from grooves 155 and 156 in the housing. These grooves serve as keyways for oppositely disposed keys on the other side of coupling ring 159. The purpose of this coupling ring is to maintain the stationary and orbiting scroll members in a predetermined fixed angular relationship.

As noted above, the driving mechanism for orbiting scroll member 130 which is used for illustrative purposes is one which incorporates means to overcome at least a fraction of the centrifugal force acting upon the stationary scroll member as the orbiting scroll member is driven. This counter-balancing means is illustrated in FIG. 18 as a swing link 170 attached through roller bearing 171 to a central shaft 172 which is affixed to or is an extension of end plate 131 of orbiting scroll member 130. A counterweight 173 of swing link 170 provides the means for overcoming a portion of the centrifugal force acting upon stationary scroll member 110 to lessen the wear on the rolling contacting wrap surfaces while achieving efficient tangential sealing.

The orbiting scroll member 130 is driven by a motor (not shown) as the driving means through main drive shaft 175 and crankshaft 176, which are integral, to which a counterweight 177 is affixed. This counterweight provides both static and dynamic balancing of the inertial forces produced by the motion of the orbiting scroll and the swing link. Crankshaft 176 is supported in drive housing section 147 by ball bearings 178 and 187, bearing 178 being held in place by a suitably affixed bearing retainer ring 179 and bearing 187 by housing lip 188. The connection 180 of swing link 170 (and hence of orbiting scroll member 130) is made to drive shaft 175 through crankshaft 176 as illustrated in FIGS. 19 and 20. This connection 180 comprises a tapered shaft 181 affixed to crankshaft 176 which extends into swing link 170 as shown in FIG. 20. Affixed to tapered shaft 181 is a ball joint 182 which is mounted in a bearing 183 held within the swing link 170 by a threaded retainer 184. Since axis 185 of the swing link is parallel to and spaced from axis 186 of main drive shaft 175 by a distance equal to the orbit radius of orbiting scroll member 130, rotation of drive shaft 175 effects the desired orbiting of scroll member 130.

A mechanical face seal, generally indicated by the reference numeral 190, seals off fluid volume 191, defined within housing section 146, from the atmosphere. In accordance with known practice, this mechanical face seal comprises element 193, mating rings 194 and 195, O-rings 196, 197 and 198, a seal adapter 199, a locknut 200, dowel pin 201 and a plurality of screws 202 to affix face seal 190 to drive shaft housing 147. A balancing counterweight 205 is affixed to main drive shaft 175, through screws 206, to minimize vibration in the apparatus.

A fluid line 210 leads into volume 191 defined within the chamber housing. This line is adapted for connection to a source (not shown) of a suitable pressurizing fluid, e.g., air, nitrogen or the like. A closeable oil delivery port 211 and a closeable oil withdrawal port 212 are provided for introducing and discharging lubricating oil into the apparatus. The oil works its way across the contacting surfaces of the coupling means and between the contacting surfaces of the compliance/sealing means of the stationary scroll member, and it collects in the bottom of the housing volume 213 defined between the surfaces of the two flanges 113 and 150, which serves as an oil sump. Housing section 114 has a series of vanes 214 spaced around its outer surface to serve as heat transfer and structural surfaces.

In the operation of the compressor of FIGS. 18–20, a fluid is used to pressurize volume 191 within the housing. Since the housing is generally not hermetically sealed it is usually necessary to maintain a connection between volume 191 and the source of pressurizing fluid, e.g., compressed air. Although the actual fluid pressure in housing volume 191 will be at least to some extent determined by such factors as compressor size, operating pressure range and efficiency of fluid pocket sealing required, it may be generally defined as being between the two pressure extremes within the apparatus, e.g., between inlet and discharge pressures for a compressor. The pneumatic forces acting upon the end plate 131 effect sealing between the compliance/sealing means 117 and end plate surface 133 and between compliance/sealing means 118 and end plate surface 136 thus maintaining the pressure of the fluid in the different pockets at the desired different levels. Because volume 191 is isolated from the fluid pockets defined between end plates 111 and 131 of the scroll members, the axial loading forces may be maintained at a desired level irrespective of the pressure events within the scroll pockets.

Although the apparatus of FIG. 18 is described in terms of being a compressor, it may also function as an expander when high-pressure fluid, acting as driving means, is introduced into central pocket 137.

By making the actual sealing contacts between the involute wraps and their opposing plates through the compliance/sealing means of this invention, it is possible to attain efficient radial sealing throughout the entire length of each wrap even though there exist radial temperature gradients and some uneven wear is experienced. Likewise, the maximum tangential sealing can be maintained with the use of such apparatus wherein means are provided to attain efficient tangential sealing with minimum leakage and wear.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

We claim:

1. In a positive fluid displacement apparatus into which fluid is introduced through an inlet port for circulation therethrough and subsequently withdrawn through a discharge port, and comprising a stationary scroll member having an end plate and an involute wrap and an orbiting scroll member having an end plate and an involute wrap, driving means for orbiting said orbiting scroll member with respect to said stationary scroll member whereby said involute wraps make moving line contacts to seal off and define at least-one moving pocket of variable volume and zones of different fluid pressure on both sides of said moving line contact, coupling means to maintain said scroll members in fixed angular relationship, means for providing an axial force to urge said involute wrap of said stationary scroll member into axial contact with said end plate of said orbiting scroll member and said involute wrap of said orbiting scroll member into axial contact with said end plate of said stationary scroll member thereby to achieve radial sealing of said pockets, and tangential sealing means for effecting tangential sealing along said moving line contacts, the improvement comprising a channel in the contacting surface of each of said wraps formed to follow the configuration of said wrap; and compliance/sealing means through which said axial contact is effected associated with each of said involute wraps; each of said compliance/sealing means comprising in combination a seal element of the same involute configuration as said channel, seated in said channel and having a width which is less than the width of said channel to permit it to experience small radial and axial excursions within said channel, said seal element having a contacting surface width which is less than the width of said wrap; and force applying means for actuating said seal element to effect said axial contact while maintaining the integrity of said tangential sealing during operation of said apparatus.

2. A positive fluid displacement apparatus in accordance with claim 1 wherein said force applying means comprises an involutely configured elastomeric member in said channel in axial force applying relationship with said seal element.

3. A positive fluid displacement apparatus in accordance with claim 1 wherein said seal element is formed of a self-lubricating synthetic resin.

4. A positive fluid displacement apparatus in accordance with claim 1 wherein said force applying means are at least in part pneumatic forces and comprise pressurized fluid within said channel derived from the one of said zones on said sides of said moving line contact having the greater fluid pressure and wherein said integrity of said tangential sealing is maintained through radial force exerted by said pressurized fluid which causes one side of said seal element to contact that side of said channel nearer the other of said zones having the lesser fluid pressure.

5. A positive fluid displacement apparatus in accordance with claim 4 including a plurality of spaced apart springs in compression retained in said channel in axial force applying relationship to said seal element thereby to effect said axial contact.

6. A positive fluid displacement apparatus in accordance with claim 1 wherein said force applying means comprises an involutely configured spring/seal in said channel in axial force applying relationship with said seal element.

7. A positive fluid displacement apparatus in accordance with claim 6 wherein said spring/seal has a U-shaped cross sectional configuration.

8. A positive fluid displacement apparatus in accordance with claim 6 wherein said spring/seal comprises in combination a stepped seal strip with two contacting end surfaces and opposing involutely configured wave springs to urge said end surfaces into contact with the surfaces of said channel and said seal element.

9. A positive fluid displacement apparatus in accordance with claim 1 wherein said seal element is formed of metal.

10. A positive fluid displacement apparatus in accordance with claim 9 wherein said seal element has a lubricant channel in that surface through which said axial contact is effected.

11. A positive fluid displacement apparatus, comprising in combination a. a stationary scroll member comprising an end plate and an involute wrap having a channel in the contacting surface thereof:

b. an orbiting scroll member comprising an end plate and an involute wrap having a channel in the contacting surface thereof;

c. driving means, incorporating a main shaft and an orbiting scroll member shaft parallel therewith, for orbiting said orbiting scroll member whereby said involute wraps make moving line contacts to seal off and define at least one moving pocket of variable volume and zones of different fluid pressure on both sides of said moving line contact, said driving means including radial compliant linking means between said main shaft and said orbiting scroll member shaft to attain tangential sealing along said moving line contacts;

d. high-pressure fluid conduit means communicating with the zone of highest pressure and low-pressure fluid conduit means communicating with the zone of lowest pressure;

e. coupling means to maintain said scroll members in fixed angular relationship;

f. means for providing an axial force to urge said involute wrap of said stationary scroll member into axial contact with said end plate of said orbiting scroll member and said involute wrap of said orbiting scroll member into axial contact with said end plate of said stationary scroll member thereby to achieve radial sealing of said pockets; and g. compliance/sealing means associated with each of said involute wraps each compliance/sealing means comprising in combination (1) a seal element through which said axial contact is effected of the same involute configuration as said channel of its associated wrap, sealed in said channel and having a width which is less than the width of said channel to permit it to experience small radial and axial excursions within said channel, said seal element having a contacting surface width which is less than the width of said wrap; and (2) force applying means for actuating said seal element to effect said radial sealing while maintaining the integrity of said tangential sealing during operation of said apparatus.

12. A positive fluid displacement apparatus in accordance with claim 11 wherein said force applying means comprises an involutely configured elastomeric member in said channel in axial force applying relationship with said seal element.

13. A positive fluid displacement apparatus in accordance with claim 11 wherein said force applying means comprises an involutely configured spring/seal in said channel in axial force applying relationship with said seal element.

14. A positive fluid displacement apparatus in accordance with claim 11 wherein said seal element is formed of a self-lubricating synthetic resin.

15. A positive fluid displacement apparatus in accordance with claim 11 wherein said radial compliant linking means include means to provide a centripetal radial force adapted to oppose at least a fraction of the centrifugal force acting upon said stationary scroll member, whereby tangential sealing is attained by the radial force between said orbiting and stationary scroll members at a level to minimize both wear and internal fluid leakage.

16. A positive fluid displacement apparatus in accordance with claim 11 wherein said driving means include motor means connected with said main shaft and said apparatus is a compressor.

17. A positive fluid displacement apparatus in accordance with claim 11 wherein said driving means include means to introduce high-pressure fluid into said high-pressure fluid conduit and said apparatus is an expander.

18. A positive fluid displacement apparatus in accordance with claim 11 wherein said force applying means are at least in part pneumatic forces and comprise pressurized fluid within said channel derived from the one of said zones on said sides of said moving line contact having the greater fluid pressure and wherein said integrity of said tangential sealing is maintained through radial force exerted by said pressurized fluid which causes one side of said seal element to contact that side of said groove nearer the other of said zones having the lesser fluid pressure.

19. A positive fluid displacement apparatus in accordance with claim 18 including a plurality of spaced apart springs in compression retained in said channel in axial force applying relationship to said seal element thereby to effect said radial sealing.

20. A positive fluid displacement apparatus in accordance with claim 11 wherein said seal element is formed of metal.

21. A positive fluid displacement apparatus in accordance with claim 20 wherein said seal element has a lubricant channel in that surface through which said axial contact is effected.

* * * * *